United States Patent [19]

Hooks

[11] 4,186,522

[45] Feb. 5, 1980

[54] STORM WINDOW FRAME

[75] Inventor: Jimmy W. Hooks, Carrollton, Tex.

[73] Assignee: Home Craftsman Company, Inc., Irving, Tex.

[21] Appl. No.: 929,708

[22] Filed: Jul. 31, 1978

[51] Int. Cl.[2] ..... E05C 7/02

[52] U.S. Cl. ..... 49/63

[58] Field of Search ..... 49/61, 63; 160/91, 90, 160/89

[56] References Cited

U.S. PATENT DOCUMENTS

| | | | |
|---|---|---|---|
| 3,023,465 | 3/1962 | Sconzo | 160/90 X |
| 3,080,620 | 3/1963 | Mendelsohn | 160/90 X |
| 3,239,976 | 3/1966 | Hall | 160/90 X |
| 3,269,452 | 8/1966 | Pirozzi | 49/63 X |

*Primary Examiner*—Philip C. Kannan

*Attorney, Agent, or Firm*—Crisman & Moore

[57] ABSTRACT

A storm window having a peripheral frame including an integral, angulated leg portion for extension, abutment and securement to the jamb of an interior window. The storm window of the present invention includes a window frame extrusion having a plurality of integrally formed slide tracts for receiving a window unit therein, and an inwardly facing flange portion extending therearound at a selected angle relative thereto. The angulated flange includes an outer planar flange portion in generally parallel spaced relationship with said slide track portions for direct securement to a window jamb of an existing window. This particular construction facilitates the flush securement and sealing of the storm window of the present invention to the existing window in a manner facilitating installation and reducing thermal conductivity between the adjacent window structures as well as air infiltration therebetween. The angulated flange further provides structural integrity beyond that of contemporary storm window constructions. In this manner, the storm window of the present invention may be affixed to a conventional interior window in a manner permitting access to the storm window without interference between it and the original window and in a manner substantially reducing air infiltration, conduction and radiation heat loss.

10 Claims, 4 Drawing Figures

STORM WINDOW FRAME

BACKGROUND OF THE INVENTION

The present invention relates to storm windows and, more particularly, to an improved storm window frame unit having an angulated, peripheral flange for direct interengagement with an existing window jamb.

Energy conservation in residential housing is of prime import in contemporary society. In that respect, conventional single glaze windows have been shown to be the biggest single cause of energy loss in the typical home. Energy is lost first through air infiltration around the window frame and sash. Window energy loss is also predominant via radiation through the glass in the window lites. It has been shown that approximately three (3) times as much energy is lost via radiation through the window lite as is normally lost from air infiltration. This is particularly so because one square foot of glass conducts at least ten times as much heat as one square foot of conventional wall. Glass has an R factor, or thermal resistance value, of 0.88. A conventional insulated wall provides a resistance, or R factor of 13 or better. Overall conventional windows have been shown to exhibit problems in over 80 percent of all homes. This figure exceeds half a billion windows without including the window problems of office buildings and other types of commercial establishments. Such an energy problem accounts for a great fuel loss which under the present fuel crisis renders the correction of such problem matters of national socio-economic import.

Conventional window construction include both single and double hung windows, the frames of which are more conventionally constructed of steel or aluminum of the extruded variety. Most conventional homes include windows of single glass panes which, although usually effectively sealed therearound readily permit the radiation of energy therethrough. Such heat loss through radiation leads to a great energy loss and an aggravation of the energy shortage. It is thus common in present times to encounter improved window designs including double pane window constructions utilizing insulated thermal barriers between glass panes for reducing conduction heat loss. The only effective means for reducing radiation heat loss is the utilization of blinds, curtains and the like for covering the transparency of the associated window.

Another form of reducing conduction and conduction heat loss in existing single pane windows is the utilization of storm windows being affixed at the outward regions thereof for creating a dead air space therebetween. According to the National Bureau of Standards, storm windows properly installed will cut heating bills a minimum of 10 to 20 percent. At average 1977 fuel prices in a 6000 degree day climate, such as Cleveland and Chicago, the investment in storm windows which are properly installed, can be recovered in five years. Unfortunately, only about 23 million of the 75 million yearround, single family homes in the United States have storm windows on every window, as reported by the Census Bureau. Such storm windows are commonly affixed directly to the frame or jamb of conventional windows for creating a sealed dead air space therebetween. Most prior art construction includes an insulation member such as box vinyl disposed between the existing window jamb and the window frame of the storm window. The insulation member reduces heat transfer and serves as a spacer for separating the two windows.

Conventional storm windows are fabricated from extruded aluminum facilitating the fabrication of multiple slide channels for receiving a plurality of sashes. The storm window is affixed to the existing window jamb by the utilization of screws or the like extending through an outer flange formed around the storm window frame. The flange is constructed in generally parallel relationship with the integrated window channel units of the storm window frame which peripheral extension in parallelism necessitates the use of a channel insulating element between the storm window and the conventional window for separation therebetween. The separation facilitates the creation of a dead air space as well as eliminating interference between the moving parts of the conventional window and the storm window. Without the separation the use and effectiveness of the window would be lessened.

Certain problems inherent in the fabrication and installation of conventional storm windows is the outer securement flange which usually necessitates the incorporation of an insulated channel member thereunder when applied to conventional windows. This channel member must be extruded from plastic or similar insulative material and include a flange configuration in itself for sealably engaging the subject storm window flange therewithin. The channel must also be of sufficient rigidity to withstand the compression and intrusion of fasting members therethrough. In short, most prior art storm window construction necessitates the creation of a suitable insulative channel and the disadvantages of securing the window thereupon which provides numerous areas of installation error and insulation ineffectiveness. Such problems may cause air infiltration and related energy loss of the type sought to be eliminated by the use of the storm window in the first place. It would be an advantage, therefore, to provide a storm window in a frame having a configuration which would eliminate the need for insulative channels and the related problems associated therewith.

The storm window of the present invention is provided for just such an application wherein the extruded frame of the storm window includes the angulated flange portion extending away from the extruded channel portion for purposes of installation and operation. The angulated flange includes a generally coplanar flange therearound for direct abutting engagement with the window jamb. In this manner, a substantially flat insulating gasket or plasticized sealant may be utilized between the existing window jamb and the storm window flange instead of a separate type insulating member of the prior art box vinyl variety. In this manner, the installation of the storm window of the present invention is greatly facilitated and the effectiveness of the sealing therebetween is maximized.

SUMMARY OF THE INVENTION

The present invention relates to storm windows of the type having an extruded frame portion for securement to jambs of existing windows. More particularly, one aspect of the present invention includes an extruded storm window frame section having a plurality of slide channels constructed therein and an outwardly extending angulated flange portion having an outwardly extending generally coplanar flange region for abutting securement to convention window jambs. The angulated leg portion is an integral extruded element of the storm window frame; formed at an angle sufficiently acute to provide extension of the storm window from the existing window jamb for the creation of a dead air space therebetween. The aforesaid space also eliminates interference between the adjacent windows. The outer coplanar flange portion therearound is provided in generally parallel spaced relationship with the channel members of the storm window frame for direct, sealed securement to the window jamb of the conventional window. The use of box vinyl and the like is eliminated by the use of a sealant or insulating gasket therebetween for eliminating thermal heat conduction.

In another aspect of the invention, the improved storm window includes an extruded frame section having an angulated leg portion for direct engagement with the window jamb of conventional interior windows. The utilization of the angulated leg portion eliminates the need for box vinyl and related prior art insulating spacers. The frame is extruded with the angulated portion intersecting a selectively staggered axis of the plurality of sash slide channels for improving the structural rigidity thereof. The integral extension leg may thus provide improved frame strength while allowing the associated storm window to stand out from the conventional window unit without incorporation of box vinyl or the like.

BRIEF DESCRIPTION OF THE DRAWINGS

For a more complete understanding of the present invention, and for further objects and advantages thereof, reference may be now had to the following description taken in conjunction with the accompanying drawings in which.

DETAILED DESCRIPTION

Figure 1:
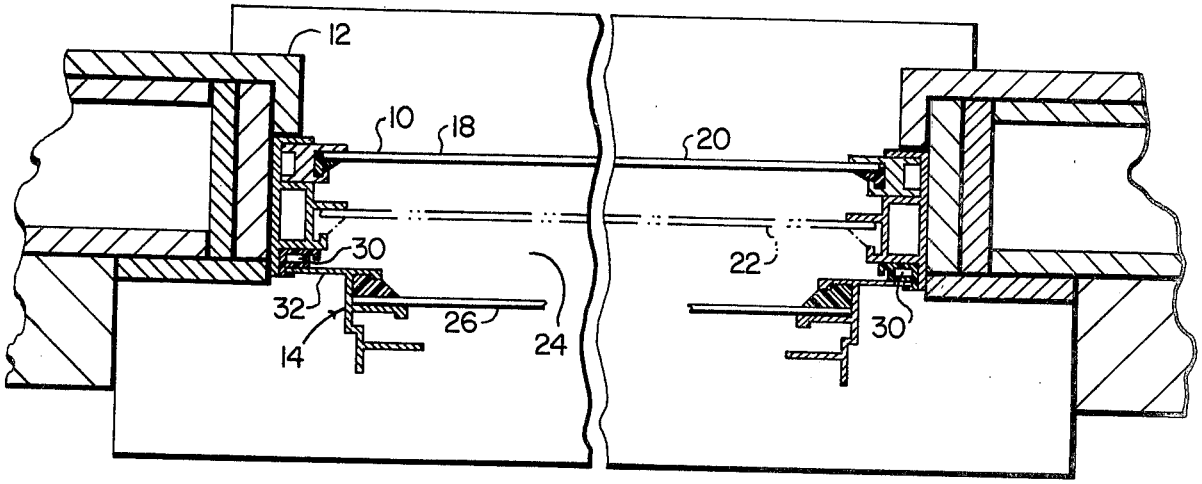
FIG. 1 (PRIOR ART)
FIG. 1 is a top plan, cross-sectional view of a prior art window installation having a storm window secured outwardly thereof and illustrating the utilization of a box vinyl spacer between the inside window and the storm windows of the prior art.

Referring first to FIG. 1 there is shown one prior art construction of a conventional window 10 secured within a window casing 12 and have a prior art storm window 14 installed outwardly thereof. The storm window 14 is secured to the jamb 16 of the window 10 outwardly of the window lites 18. The window 10 as shown in FIG. 1 is a conventional double hung window having an inside window sash 20 and outer window sash 22. The utilization of the storm window 14 as shown in FIG. 1 creates a dead air space 24 between the lite 26 of the storm window 14 and the conventional inner window 10.

Still referring to FIG. 1, it may be seen that the storm window 14 is installed adjacent the conventional window 10 by the utilization of a "standoff" type insulating member 30 secured beneath a lateral, peripheral flange 32 of the storm window 14 and against the window jamb 16 of the conventional window. Conventional threaded fasteners such as sheet metal screws (not shown) are commonly utilized to secure the storm window 14 to the conventional window 10 with the insulating member 30 therebetween. Most insulating members 30 are formed of plastic or suitable thermally dielectric material having low thermal conductivity and in a configuration having a substantial cross sectional rigidity for causing the window 14 to outstand from its position adjacent the window 10. The utilitzation of box vinyl and the like has been common in the prior art for such stand off members 30. The inherent disadvantage of box vinyl is the problem of cutting it to precise lengths and causing the ends to be "sealed" together to prevent air infiltration. Moreover, such plastic material is deformable and presents installation problems in association with the use of threaded fasteners such as sheet metal screws.

Figure 2:
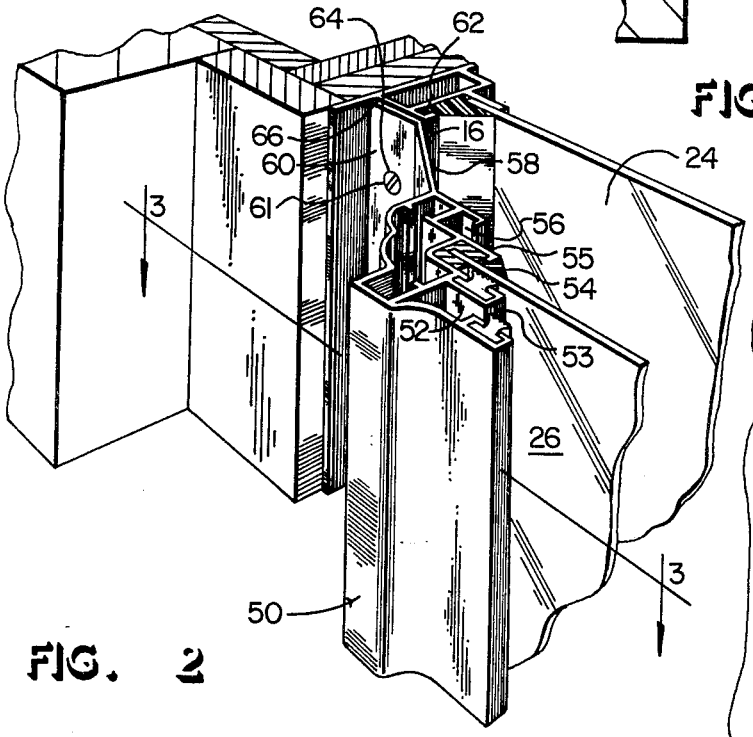
FIG. 2 is a fragmentary, perspective view of the improved storm window frame of the present invention illustrating the installation thereof adjacent the window jamb of a conventional window structure.

Referring now to FIG. 2 there is shown one embodiment of a storm window 50 constructed in accordance with the principles of the present invention and installed adjacent the jamb of a conventional interior window 10. The window 50 of the present invention includes a plurality of conventional slide tracks 52, 54 and 56 in staggered inter-relationship one with the other. The window tracks are provided adjacent a peripheral, angulated leg portion 58 extending outwardly therefrom and inwardly toward the window 10, terminating in a substantially flat outer, peripheral flange portion 60. The flange portion 60 is formed generally coplanarly with the lite 26, and/or in a generally parallel spaced relationship relative to the various side wall elements 53 and 55 of the tracks 52, 54 and 56. This "coplanar" relationship permits positioning of the window 50 in generally parallel spaced relationship with the existing window 10 relative thereto. As will be described in more detail below, the angulated leg 58 permits the creation of a dead air space between the adjacent windows as well as facilitating the installation, utilization and maximum effectiveness of the storm window 50 of the present invention.

Still referring to FIG. 2 there is shown the installation of the window 10 in abutting relationship with the window jamb 62 of the conventional interior window 10. The flange 60 is disposed in abutting relationship with the jamb 62 and secured thereto with suitable fastening members such as sheet metal screws 64. A thermal insulating strip 66 is preferably provided between the flange 60 and the window jamb 62 for reducing thermal conductivity therebetween and improving the resistance to air infiltration. The angulation of the member 58 causes the creation of a dead air space 68 between said windows and the space facilitates operator access to the window channel 56 within the window structure 50 while reducing interference between window unit 50 and the conventional window unit 10 adjacent thereto. It may be seen from FIG. 2 that the utilization of box vinyl stripping and the like has been eliminated since the spacing relationship between the existing window 10 and the storm window 50 is facilitated through the angulation of the leg member 58. Assembly is thus facilitated with greater efficiency due to the elimination of cutting of the box vinyl, as is common in most prior art installations. In like manner, the cost of the insulating stripping 66 which may be a conventional sealant, is considerably cheaper than that of box vinyl.

Figure 3:
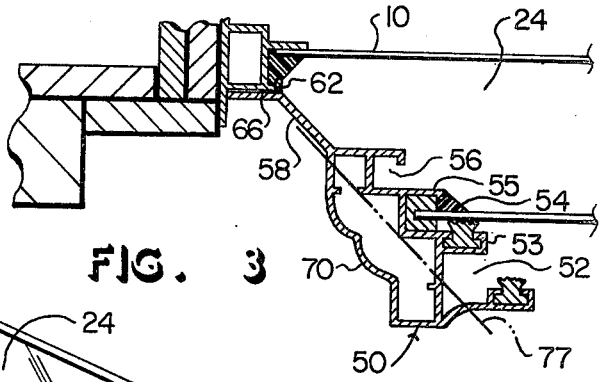
FIG. 3 is a top plan, cross-sectional view of the storm window installation of FIG. 2 taken along lines 3—3 thereof and illustrating the securement of the improved storm window to the conventional window jamb.

Referring now to FIG. 3 there is shown a conventional window unit 10 having secured outwardly thereof the storm window unit 50 of the present invention as viewed from a top plan, cross-sectional view. It may be seen that the angulated leg portion 58 presents the window unit 50 relative to the existing window unit 10 in an optimally positioned configuration. The space between the adjacent window units is a function of a construction angle of the angulated leg portion 58. The angle of the leg portion 58 is preferably substantially aligned with the staggering axis of the staggered configuration of the channels 56, 54 and 52 of the storm window unit 50, which axial alignment permits structural rigidity in the form of a lateral grid extension. The aforesaid staggering axis is represented by phantom line 77 for purposes of clarity which is preferably formed at an oblique angle between 140 and 160 degrees relative to the coplanar flange. An angle of 150 degrees is shown herein and has been shown to be optimal. An outer cover 70 is provide outwardly of the staggered track unit and in generally axial alignment with the staggering axis for complementing the structural and aesthetic configuration thereof.

Still referring to FIG. 3, it may be seen that the installation of the storm window unit 50 of the present invention adjacent the conventional window unit 10 is facilitated by the elimination of the box vinyl unit 30 of the prior art configurations. Conventional fastener members 64 may be inserted directly into the flange element 60 through holes 61 provided therein. The flange 60 encompasses the angulated leg portion 58 therearound and provides structural rigidity to the overall unit. The incorporation of the flat insulation gasket 66 immediately thereunder further facilitates energy conservation between the adjacent window units as well as installation efficiency.

Figure 4:
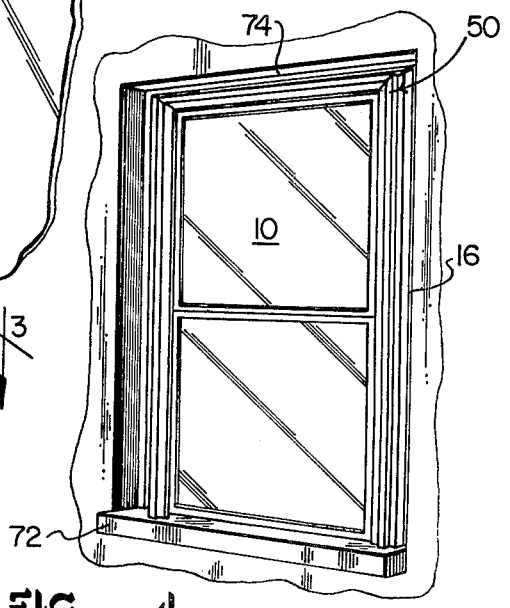
FIG. 4 is a perspective view of the storm window of the present invention installed adjacent a conventional window, illustrating the outward appearance thereof and the effect of the angulated extension leg thereof.

Referring now to FIG. 4 there is shown a perspective view of the storm unit 50 of the present invention installed adjacent an existing window unit 10 of conventional design. As seen most clearly in FIG. 4 the window sill 72 underlies the base of the window unit 50. A conventional head 74 outlines the uppermost portion of the window unit 50 as said storm window is secured between the head and sill portion 74 and 72 respectively in the same manner as said window is secured to the jamb 16. The positioning of the storm window 50 adjacent the conventional window unit 10 permits the creation of the dead air space as defined above and in the present configuration facilitates a tapered configuration tapering inwardly from the inside window 10.

It may be seen from the present invention that the frame section 50 of the present invention may be extruded with aluminum in a conventional manner and in a construction facilitating maximum structural rigidity as well as facilitating the thermal insulation of conventioal windows. This particular construction, while eliminating the need for box vinyl, may be effectively fabricated for a cost equivalent to prior art window constructions not having the angulated leg portion 58. Installation is also simplified not only by elimination of the box vinyl unit and replacement with a thin, flat insulating medium; but by also providing a flange configuration standing outwardly from the existing unit to facilitate the handling thereof during assembly. In this manner, various other forms of insulation and sealing elements may replace the box vinyl unit 30 such as latex caulk. In installations requiring immediate assembly, double-sided tape may also be utilized and used for immediate assembly until suitable threaded fasteners are incorporated. Such an assembly further expands the possibilities of caulking and sealing mediums as well as wall thickness for the particular extruded tracts in that the structural configurations is enhanced due to the angulated leg configuration. The tapered configuration of the frame 50 also reduces the amount of outwardly exposed glass in the outer track 52 therein reducing the amount of radiated heat loss therethrough.

It is thus believed that the operation and construction of the present invention will be apparent from the foregoing description. While the apparatus as shown and described has been characterized as being preferred it will be obvious that various changes and modifications may be made therein without departing from the spirit and scope of the invention as defined in the following claims.

What is claimed:

1. An improved storm window structure for assembling outwardly of existing window jambs, said storm window being of the type having a plurality of sash receiving tracts integrally formed within a window frame channel and secured to an existing window frame jamb for creating a sealed dead air space therebetween, said improvement comprising a window frame channel having a plurality of sash receiving tracks staggered in a tapering configuration in axial alignment with an inwardly extending flange portion comprising a leg element which leg element includes a substantially coplanar flange portion disposed outwardly thereof in generally parallel spaced relationship with said sash receiving tracks for being received directly against the planar jamb of an existing window for securement and sealing thereagainst and the creation of a dead air space therebetween.

2. The apparatus as set forth in claim 1 wherein said co-planar flange of said leg element is provided with a plurality of holes therethrough for receiving threaded fasteners for securement against the planar jamb of an existing window.

3. The apparatus as set forth in claim 1 wherein said angulated leg element includes an extruded frame portion formed at an oblique angle between 140 and 160 degrees relative to the coplanar flange element disposed therearound.

4. The apparatus as set forth in claim 3 wherein said angulated leg unit is formed at an angle of 150 degrees relative to said coplanar flange element.

5. The apparatus as set forth in claim 1 wherein at least two window sash tracks are provided within said window frame unit and said frame channel is of a unitary, extruded construction.

6. The apparatus as set forth in claim 5 wherein at least three window sash tracks are provided within said window frame unit.

7. The apparatus as set forth in claim 1 wherein said window frame channel is formed of aluminum and said flange portion disposed outwardly therearound has received thereagainst a flat insulating and sealing medium.

8. The apparatus as set forth in claim 7 wherein said flat insulating and sealing medium is a thin strip of vinyl.

9. The apparatus as set forth in claim 1 wherein the ends of said sash receiving tracks are staggered in a tapering axis and enclosed within an outer cover in generally axial alignment with the tapering axis.

10. The apparatus as set forth in claim 9 wherein said tapering axis is an oblique angle of approximately 150 degrees relative to said sash receiving tracks.

* * * * *